US005369625A

United States Patent [19]

Gabrielson

[11] Patent Number: 5,369,625

[45] Date of Patent: Nov. 29, 1994

[54] THERMOACOUSTIC SOUND GENERATOR

[75] Inventor: Thomas B. Gabrielson, Warminster, Pa.

[73] Assignee: The United States of America as represented by the Secretary of the Navy, Washington, D.C.

[21] Appl. No.: 709,901

[22] Filed: May 31, 1991

[51] Int. Cl.[5] ..... H04R 23/00

[52] U.S. Cl. ..... 367/140; 367/141; 367/142; 181/120; 116/DIG. 19; 116/DIG. 22

[58] Field of Search ..... 367/140, 141, 142; 181/110, 120; 116/DIG. 18, DIG. 19, DIG. 22; 73/662

[56] References Cited

U.S. PATENT DOCUMENTS

| | | | |
|---|---|---|---|
| 2,836,033 | 5/1958 | Marrison | 116/DIG. 22 |
| 3,042,115 | 7/1962 | Brandon | 116/DIG. 22 |
| 3,371,309 | 2/1968 | Rich | 367/140 |
| 4,948,360 | 8/1990 | Wells | 431/1 |

*Primary Examiner*—J. Woodrow Eldred

*Attorney, Agent, or Firm*—James V. Tura; James B. Bechtel; Susan E. Vernoa

[57] ABSTRACT

A submersible acoustic generator for projection of sound waves into a body of water comprises a tubular resonator, open at its lower end and closed at its upper end, and having a multiple-plate thermoacoustic stack located near the upper end between a pair of heat exchangers which set up a temperature gradient in the stack. The upper heat exchanger is heated by a chemical fuel, and the lower heat exchanger is cooled by the surrounding water. The resonator is gas-filled, and the wavelength of the oscillations produced is approximately twice the length of the resonator. A portion of the resonator tube can be surrounded by a coaxial tube which serves as an impedance matching stub. The stack plates can be made anisotropic by means of embedded copper wires. In alternative versions of the apparatus, the resonator can have two stacks, one near the open end and the other near the closed end, and the temperature gradient in the stack can be established cryogenically.

10 Claims, 3 Drawing Sheets

THERMOACOUSTIC SOUND GENERATOR

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

This invention relates to sound generation, and more particularly to a high power thermoacoustic sound generator having the unique capability of efficiently projecting sound into a body of water. The invention has utility in various applications such as geophysical exploration, anti-submarine warfare, environmental monitoring by acoustic tomography.

Conventional high power sound generators for underwater use utilize piezoceramic or magnetostrictive materials driven electrically by power derived from batteries. While these conventional generators are capable of delivering high power, they are subject to several drawbacks.

One drawback is the large space occupied by the conventional sound source, which includes not only the piezoceramic or magnetostrictive element, but also its associated parts. These associated parts may include one or more batteries, an oscillator, and amplifier, and a mechanical displacement multiplier.

Even highly efficient batteries, such as lithium batteries have limited energy and power densities. For example, the energy density for a $LiSOCl_2$ battery is in the vicinity of 0.7 kilojoules per cubic centimeter ($kJ/cm^3$), and its maximum power density is in the vicinity of 3 watts per cubic centimeter ($W/cm^3$). While the oscillator does not ordinarily take up a significant amount of space, a power amplifier does. A power amplifier capable of producing an output of several kilowatts, even if designed for maximum power and minimum volume, may only produce about 2 $W/cm^3$. Thus, from a power density standpoint, the amplifier may take up even more volume than the battery.

Another drawback, in the case of piezoceramic transducers, is the fact that they are inherently high impedance devices, requiring high voltage for their operation. Since battery voltage is limited by the number of cells, a power transformer is generally required. Furthermore, since the piezoceramic element is primarily capacitive, an impedance matching inductor is also generally necessary. The total power density for the transformer and inductor is in the vicinity of 3 $W/cm^3/Khz$. While a magnetostrictive transducer may not require a power transformer, since it is a high current device, an impedance-matching capacitor is usually required. The reactive elements needed to operate piezoceramic and magnetostrictive transducers, therefore, take up space in addition to that occupied by the batteries and power amplifiers.

Still another drawback is the fact that both piezoceramic and magnetostrictive transducers are limited in the amount of strain which they can produce. Displacement multiplying techniques, e.g. the so-called "flextensional" configuration described in U.S. Pat. No. 4,420,826, dated Dec. 13, 1983, are used to produce increased displacement. However, for such displacement multiplying techniques to be effective, the transducer must be backed by a medium more compliant than the water in which the transducer is immersed. Air is normally used to fill the inner volume of the transducer for this purpose. Unfortunately, the requirement for a compliant medium limits the depth of operation of the transducer since, at greater depths, the increased stiffness of the air reduces the displacement multiplication. Furthermore, for deep water operation, the transducer structure must be made strong enough to withstand the wide range of hydrostatic pressures encountered, or a pressure compensation system must be provided to keep the internal gas pressure close to the external hydrostatic pressure.

With conventional piezoceramic and magnetostrictive transducers, so long as the dimensions of the radiating surface of the transducer are smaller than the acoustic wavelength, the power output at a specific frequency is proportional to the square of the radiating surface area multiplied by the square of the displacement of the radiating surface. Therefore, if the transducer volume is constrained, it is necessary to produce large displacements to obtain high power output. But, to obtain large displacements, it is necessary to provide more or larger batteries, larger electronic components, and, in some cases, displacement multipliers. All of these elements take up substantial amounts of space. Therefore, it has not been possible to make small-sized, high power transducers for generating sound in water, using conventional piezoceramic and magnetostrictive transducers.

Another way to generate sound is by thermoacoustics. Thermoacoustic sound generation is accomplished by establishing a thermodynamic cycle in which an acoustic vibration itself provides the mass transport, and a stationary medium controls the heat transport. The process exploits the particular phase relationship between local pressure oscillations and local oscillations in the elemental volume in an acoustic wave. By appropriately positioning the second stationary medium in the acoustic flow and imposing a large temperature gradient on the second medium, heat can be transferred to and from the cycle with the phase required to generate high-amplitude oscillations. Although thermoacoustic sound generation is known, no practical way has heretofore been found to produce high power acoustic vibrations in bodies of water using thermoacoustic principles.

SUMMARY OF THE INVENTION

This invention utilizes a thermoacoustic sound generator, which, by direct heat-to-sound conversion, produces high power acoustic waves in water, thereby avoiding the several drawbacks which are inherent in the use of conventional piezoceramic and magnetostriction transducers.

The apparatus in accordance with the invention comprises a resonator tube closed at one end and open at its opposite end. While the tube will normally be elongated, the diameter of the tube can be slightly greater than its length. The ratio of the diameter of the tube to its length should be less then 1.2:1 in order to prevent spurious modes of oscillation.

A thermoacoustic stack is situated within the tube. The stack preferably comprises a set of parallel, spaced plates situated in planes parallel to the length of the tube. The stack has its opposite ends spaced from each other in the direction of elongation of the tube. Means are provided for establishing a temperature difference between the ends of the stack whereby one of the ends is hotter than the other end. In the preferred form of the invention, the temperature difference is achieved by means of a chemical reaction which heats one end of the stack through a heat exchanger, while the body of water in which the apparatus is submerged is thermally coupled to the other end of the stack and serves as a heat sink. The tube is substantially filled with gas so that, when the tube is submerged in a body of water with substantially the entire tube situated above the level of the open end, water is prevented from moving a significant distance into the tube through the open end.

The invention is the first use of a thermoacoustic driver in an underwater acoustic source, and the first use of a tuned, gas-filled resonator coupled to water, as a power radiating device.

The principal object of the invention is to provide a sound generation device for projecting sound into a body of water, which takes up a relatively small amount of space, but which is capable of producing a high power output.

A further object of the invention is to provide a self-contained sound generation apparatus which can be activated after long periods of dormancy, so that it is especially suitable for use in buoys, decoys, and in similar applications.

Other objects, advantages and novel features of the invention will become apparent from the following detailed description of the invention when considered in conjunction with the accompanying drawings wherein:

DESCRIPTION OF THE PREFERRED EMBODIMENTS

Before proceeding to a description of the structural details of the sound generator of the invention, the general operation of a thermoacoustic stack will be briefly described.

Figure 1:
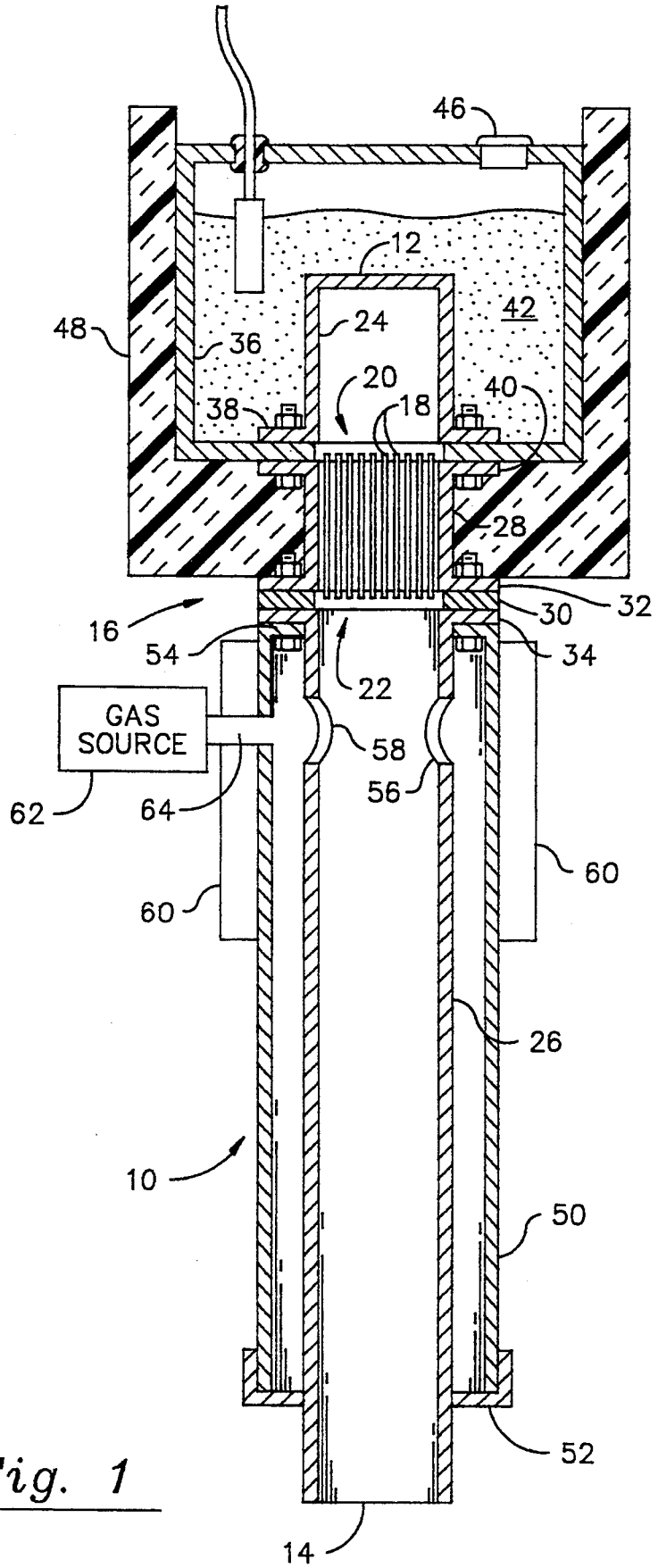
FIG. 1 is an axial section through a submersible thermoacoustic sound generator in accordance with the invention.

Referring to FIG. 1, a typical thermoacoustic source in accordance with the invention comprises a resonator tube 10 closed at one end 12 and open at the opposite end 14, and containing a thermoacoustic stack 16. A typical thermoacoustic stack comprises a plurality of spaced plates 18 of SS304 stainless steel, having their surfaces situated in planes parallel to the length of the tube. These plates are preferably spaced from each other by about four times the thermal boundary layer thickness. The boundary layer thickness $d_h$, also known as the "thermal penetration depth", is defined by:

$$d_h = \sqrt{\left(\frac{2k}{\omega_p C_p}\right)}$$

where:

k is the thermal conductivity of the gas:

$\omega$ is $2\pi$ times the acoustic frequency;

$\rho$ is the gas density; and $C_p$ is the specific heat at constant pressure.

Thus, the spacing of the plates of the stack is approximately $4d_h$.

Heat exchangers 20 and 22 are provided at opposite ends of the stack. Heat exchanger 20, which is nearer the closed end of the tube, is the hot exchanger, and heat exchanger 22, nearer to the open end of the tube, is the cold exchanger.

Assume a standing wave is set up in the gas within the tube. In the standing wave, the gas oscillates along the axis of the tube, moving alternately toward and away from the closed end. As a small volume of fluid within the tube moves toward the closed end, its pressure and temperature increase and its size decreases. As the small volume moves toward the open end of the tube, its pressure and temperature decrease, and its size increases. Except at very high frequencies or near boundaries, acoustic waves are very nearly isentropic. Therefore, assuming no stack is present in the tube, the area enclosed by a PV diagram describing the small volume of fluid is zero, and there is no net energy transfer to or from the fluid.

When the stack is present, and a temperature gradient is established in the stack plates along direction of the length of the tube, a different situation prevails in small volumes of fluid located between adjacent plates 18 of the stack. Heat is transferred substantially instantaneously to and from small volumes of fluid immediately adjacent to the stack plate surfaces, and because of the instantaneous heat transfer, no net energy is transferred into acoustic oscillation. However, for volumes of fluid between the plates, but spaced from the plates, there is a phase lag in the transfer of energy. That is, the time required for thermal conduction from a plate to the volume of fluid, and from a volume of fluid to the plate, causes the temperature changes in the volume of fluid to lag behind the pressure changes. Thus, a transfer of energy takes place, in which the thermal energy which set up the temperature gradient along the stack plates is transferred to oscillatory fluid motion in the tube. So long as the temperature gradient in the plates is sufficiently high that heat transfer takes place from a hot portion of a plate to the compressed fluid, and from the expanded fluid to a cold portion of a plate, the phase lag is in the proper direction to add energy to the acoustic wave. The result is that a sustained standing wave oscillation is set up in the tube. The length of the stack should be such that it has a temperature gradient of at least 10,000 to 15,000° Kelvin per wavelength.

In the case of a fluid-filled resonator tube submerged immersed in the same fluid, the fundamental resonance is a frequency such that the length of the tube is approximately one quarter the wavelength of sound in the fluid. However, in the case of a gas-filled resonator tube submerged in water, the fundamental resonance is at a frequency such that the length of the tube is approximately equal to one half the wavelength of sound in the gas. The gas-filled resonator does not appear to be suitable for use in radiating sound into water, since the open end of the resonator is almost a node for fluid motion, and there is a large acoustic impedance difference between water and gases under low pressure. Surprisingly, however, the gas-filled, water submerged resonator is capable of good performance as a radiator of sound into a body of water.

In the apparatus of FIG. 1, the tubular resonator is made up of three interconnected tubular sections. A first tubular section 24 is the part which comprises closed upper end 12. Section 24 extends downward from closed end 12. A second section 26 includes open lower end 14, and extends upward from end 14. A third tubular section 28 is connected between sections 24 and 26, and surrounds thermoacoustic stack 16. Tubular sections 24 and 26 are preferably made from a thermally conductive material, while section 28 is made from a thermal insulator.

An annular flange 30 of heat exchanger 22 is clamped between flange 32 of tube 28 and flange 34 of tube section 26. Heat exchanger 20 is an integral part of an enclosure 36 which surrounds tube 24. The portion of the enclosure surrounding heat exchanger 20 is clamped between flange 38 of tube section 24 and flange 40 of tube section 28.

The temperature gradient in the thermoacoustic stack is obtained by generating heat chemically by a pyrotechnic mixture 42 in container 36. This mixture can be, for example, a metal/oxidizer mixture such as a mixture of aluminum powder and potassium chlorate, with a quantity of zinc or lead present to moderate the burning rate. An electroexplosive device 44 is provided to initiate the mixture. A plug 46 in a hole in container 36 permits the escape of gases generated in the combustion of mixture 42.

Container 36 is partially surrounded by insulation 48, which also surrounds tubular section 28. This insulation isolates heat exchanger 22 from the heat generated by the combustion of mixture 42.

Tubular section 26 is surrounded by a cylindrical outer tube 50, which is closed at its lower end by an annular closure 52, and which has a flange 54 at its upper end bearing against flange 34 of tubular section 26. Tubular section 26 has openings 56 and 58 near its upper end, which provide communication between the interior of section 26 and the space between tube 50 and section 26. The outer tube acts as a coaxial tuning stub to provide better matching of the acoustic impedances of the resonator and the surrounding water.

The outer tube 50, and part of the inner tube 26, are in direct contact with the surrounding water when the apparatus is submerged in a body of water. Since these tubes 26 and 50 are in thermal communication with heat exchanger 22, heat in exchanger 22 is carried away through these tubes to the surrounding water. For improved heat dissipation, radial fins 60 are provided on the outside of the upper portion of tube 50.

A gas source 62, which can be a compressed gas cylinder, or for greater compactness, a chemical gas generator, is connected to the interior of tube 50 through a conduit 64. This gas source is used to pressurize the interior of tube 26, so that the surrounding water does not rise far into the tube through opening 14. This prevents excessive mass loading of the resonator, which can impair its output. Gas pressure can be regulated to maintain the gas-water interface near opening 14. This can be easily accomplished by supplying the gas at a pressure greater than the hydrostatic pressure, and bubbling some of the gas out into the water through a small regulator tube (not shown) having an opening just above the level of opening 14. The gas contained in the tube can be air, but is preferably a relatively high molecular weight gas such as xenon, which has a molecular weight of 131. Where chemical generation of the gas is desired, gases such as Hydrogen Iodide (M.W.=128) or Hydrogen Bromide (M.W.=81) can be used. Both of these gases have two atoms per molecule. More complex gases having higher molecular weights can also be used, but they generally have poor thermal expansion coefficients, making them less desirable as thermoacoustic media.

Figure 2:
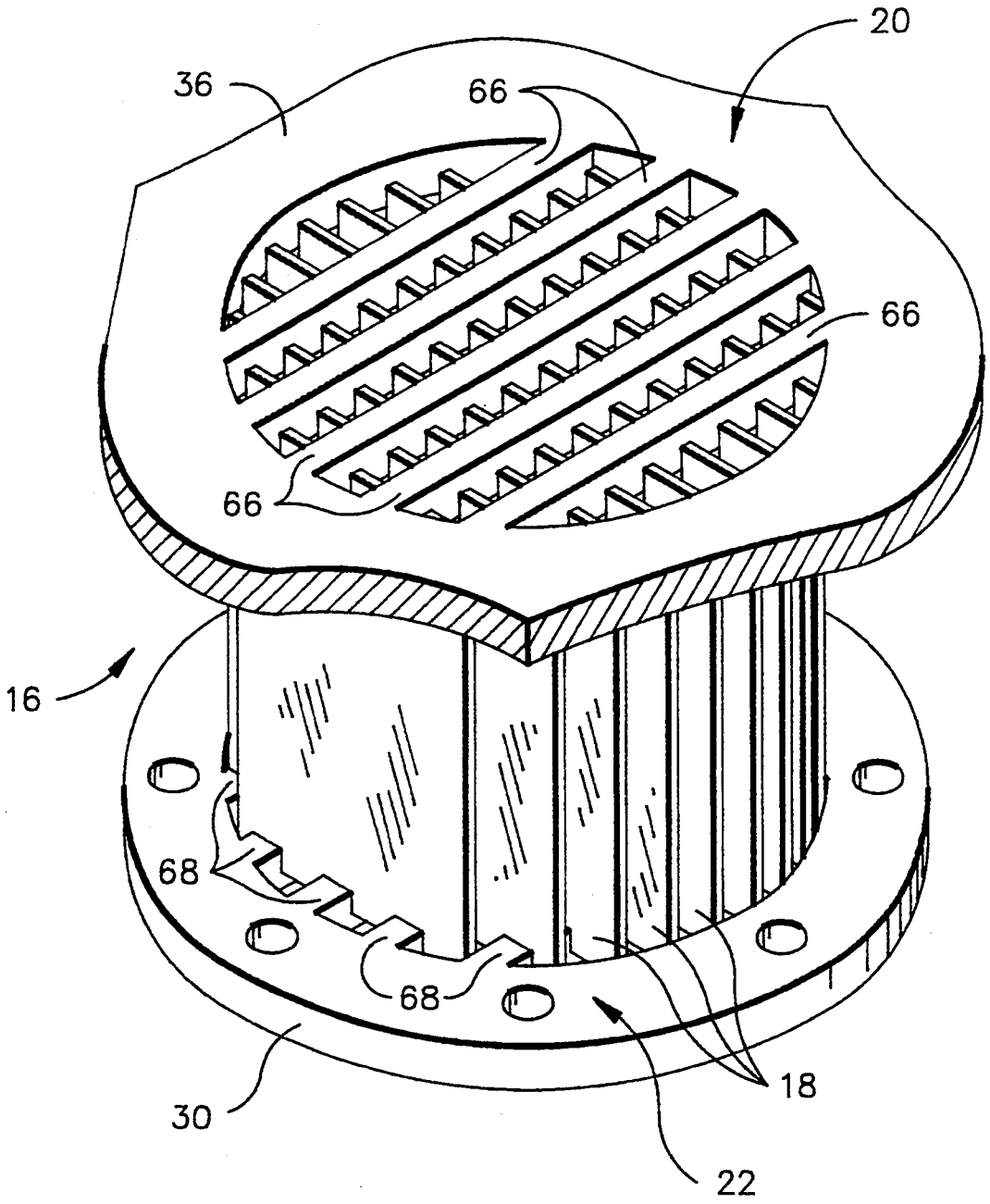
FIG. 2 is a fragmentary perspective view of the thermoacoustic stack and heat exchangers of FIG. 1.

FIG. 2 shows details of a typical thermoacoustic stack 16, as used in the apparatus of FIG. 1. The plates 18 of the stack can be made of various materials having relatively low thermal conductivity, such as stainless steel. The upper heat exchanger 20 comprises a set of spaced, elements 66 extending horizontally across an opening in the bottom portion of container 36 in transverse relationship to the stack plates 18. These elements 66 are in thermal contact with the upper edges of the plates, and conduct heat to the plates while allowing axial flow through the spaces between them. A similar set of transverse elements 68 is provided in the opening within flange 30 of heat exchanger 22, to carry heat away from the lower edges of plates 18. The multiple transverse elements of the heat exchangers help to establish uniform temperature distribution in the horizontal direction in the plates.

The circular stack configuration, as shown in FIG. 2, provides maximum resonator area for a particular frequency, and consequently allows for maximum radiated power. Rectangular stack configurations, however, may be preferred in some cases, as they provide better heat flow efficiency through the heat exchangers.

Figure 4:
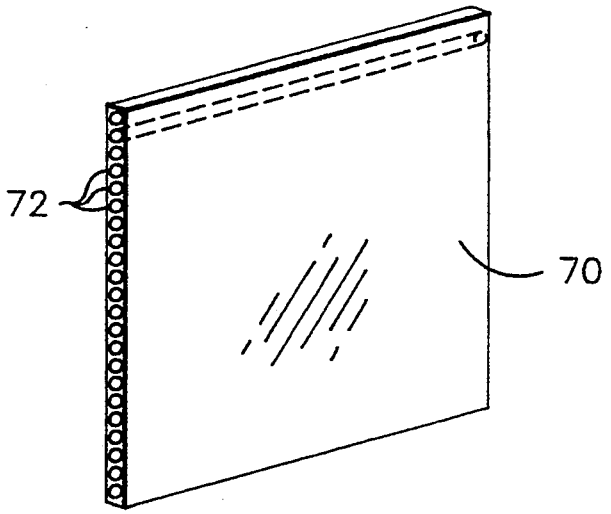
FIG. 4 is a fragmentary perspective view of an anisotropic stack plate in accordance with the invention.

An optional further measure to insure uniform temperature distribution in the plates is to make the plates anisotropic by providing special heat-conductive elements extending on the surfaces of, or within the plates in directions perpendicular to the length of the resonator tube. As illustrated in FIG. 4, plate 70 has a series of spaced, parallel copper wires 72 embedded in it, and extending in a direction perpendicular to the length of the resonator tube. An anisotropic plate can also be made by sandwiching copper wires between two sheets to make up a plate, or by electroplating copper strips onto surfaces of the plates.

In the version of the apparatus shown in FIG. 1, the stack 16 is located nearer the closed end of the resonator tube than to the open end. The hot end of the stack is nearer than the cold end to the closed end of the tube.

The stack requires both particle motion and pressure change in order to function. For a gas having an ideal viscosity of zero, the optimum position of the stack would be half way between the position of zero motion, i.e. the closed end, and the position of zero pressure change, i.e. the mid-point along the length of the tube. In order to reduce viscous losses, the stack is shifted toward the closed end. Accordingly, the distance between the cold end of the stack and the closed end of the tube is preferably less than approximately one-fourth of the length of the tube.

Figure 3:
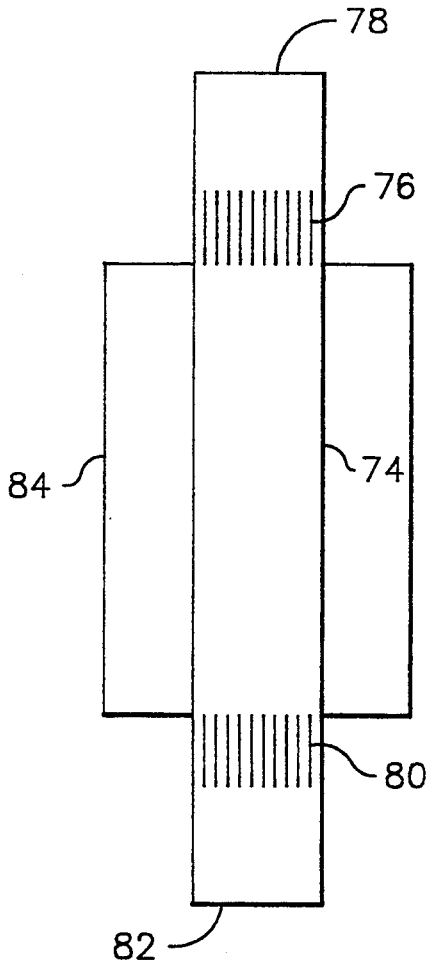
FIG. 3 is a schematic view showing an alternative version of the invention characterized by two thermoacoustic stacks.

Since the resonator tube is approximately one-half wavelength long, it is possible to use two thermoacoustic stacks in the tube, one in the position as shown in FIG. 1, and the other near the open end, with its hot end toward the opening of the tube. Such an arrangement is depicted in FIG. 3, in which resonator tube 74 has a first stack 76 near its closed end 78, and a second stack 80 near open end 82. Although the second stack imposes additional viscous losses, it eases the problem of providing large heat flows through the heat exchangers. In the apparatus of FIG. 3, the temperature gradient in the stacks is established between a cryogenic source (a liquid nitrogen-containing vessel 84 surrounding the middle portion of the tube), and the water in contact with the end portions of the tube.

The principal advantage of the thermoacoustic underwater sound source described herein is that the thermoacoustic driver is force-limited rather than displacement-limited, as is the case with piezoceramic and magnetostrictive transducers. Consequently, the large fluid displacements necessary to produce high power can be achieved in a device occupying a relatively small volume. Another advantage is that the device produces acoustic power directly from heat. Consequently, it is possible to use chemical fuels having much higher power and energy densities than those of conventional battery power sources. Still another advantage is that, since the resonator tube is gas-filled, but open at the bottom, there is no need to accommodate static pressure differentials across structural parts.

Various modifications, other than those already described, can be made to the apparatus shown in FIGS. 1–4. For example, while the resonator tubes in the devices specifically described are circular in cross-section, rectangular and other cross-sections can be used. The rectangular cross-section has certain potential advantages in reducing losses in the heat exchangers and in promoting more uniform temperatures in the several stack plates. While the invention is primarily intended to be operated by chemically generated heat, it can be operated by waste heat as well, for example waste heat from a shipboard power plant. Still other modifications will occur to persons skilled in the art, and it is therefore to be understood that within the scope of the appended claims, the invention may be practiced otherwise than as specifically described.

I claim:

1. Apparatus for projecting sound into a body of water comprising:

means providing a resonator tube, said tube being closed at one end and open at its opposite end, and having a central axis extending from the closed end toward the open end;

a thermoacoustic stack situated within said tube, said stack having first and second ends spaced from each other in the direction of the axis of the tube;

means for establishing a temperature difference between said first and second ends of the stack whereby one of said first and second ends is hotter than the other of said first and second ends; and means providing a gas for substantially filling said tube;

in which said tube-providing means, when substantially filled with said gas and submerged in a body of water with substantially the entire tube situated above the level of said open opposite end, prevents the escape of said gas so that substantial entry of water into said tube is prevented by said gas;

in which said tube comprises a first tubular section extending from said closed one end toward said open opposite end, a second tubular section extending from said open opposite end toward said closed one end, and a thermally insulating tubular means, surrounding said thermoacoustic stack;

in which said means for establishing a temperature difference between said first and second ends of the stack comprises heat generating means, first heat exchange means thermally coupling said heat generating means to said first end of the stack, and second heat exchange means for thermally coupling said second end of the stack to a surrounding body of water; and in which said insulating tubular means thermally insulates said first and second heat exchange means from each other.

2. Apparatus according to claim 1 in which said first and second heat exchange means are mechanically connected to each other through said insulating tubular means.

3. Apparatus for projecting sound into a body of water comprising:

means providing a resonator tube, said tube being closed at one end and open at its opposite end, and having a central axis extending from the closed end toward the open end;

a thermoacoustic stack situated within said tube, said stack having first and second ends spaced from each other in the direction of the axis of the tube;

means for establishing a temperature difference between said first and second ends of the stack whereby one of said first and second ends is hotter than the other of said first and second ends; and means providing a gas for substantially filling said tube;

in which said tube-providing means, when substantially filled with said gas and submerged in a body of water with substantially the entire tube situated above the level of said open opposite end, prevents the escape of said gas so that substantial entry of water into said tube is prevented by said gas;

in which said tube comprises a first tubular section extending from said closed one end toward said open opposite end, a second, heat conductive, tubular section extending from said open opposite end toward said closed one end, and a thermally insulating tubular means, surrounding said thermoacoustic stack, and connecting said first and second tubular sections together;

in which said means for establishing a temperature difference between said first and second ends of the stack comprises heat generating means, first heat exchange means thermally coupling said heat generating means to said first end of the stack, and second heat exchange means thermally coupling said second tubular section to said second end of the stack;

in which said second tubular section is submersible in said body of water in thermal contact therewith; and in which said insulating tubular means thermally insulates said first and second heat exchange means from each other.

4. Apparatus according to claim 3 in which said first and second heat exchange means are mechanically connected to each other through said insulating tubular means.

5. Apparatus for projecting sound into a body of water comprising:

means providing a resonator tube, said tube being closed at one end and open at its opposite end, and having a central axis extending from the closed end toward the open end;

a thermoacoustic stack situated within said tube, said stack having first and second ends spaced from each other in the direction of the axis of the tube;

means for establishing a temperature difference between said first and second ends of the stack whereby one of said first and second ends is hotter than the other of said first and second ends; and means providing a gas for substantially filling said tube;

in which said tube-providing means, when substantially filled with said gas and submerged in a body of water with substantially the entire tube situated above the level of said open opposite end, prevents the escape of said gas so that substantial entry of water into said tube is prevented by said gas; and in which said means for establishing a temperature difference between said first and second ends of the stack comprises a chemical heat generator fixed to said tube, first heat exchange means thermally coupling said chemical heat generator to said first end of the stack, and second heat exchange means for thermally coupling said second end of the stack to said body of water.

6. Apparatus for projecting sound into a body of water comprising:

means providing a resonator tube, said tube being closed at one end and open at its opposite end, and having a central axis extending from the closed end toward the open end;

a thermoacoustic stack situated within said tube, said stack having first and second ends spaced from each other in the direction of the axis of the tube;

means for establishing a temperature difference between said first and second ends of the stack whereby one of said first and second ends is hotter than the other of said first and second ends; and means providing a gas for substantially filling said tube;

in which said tube-providing means, when substantially filled with said gas and submerged in a body of water with substantially the entire tube situated above the level of said open opposite end, prevents the escape of said gas so that substantial entry of water into said tube is prevented by said gas;

in which said tube comprises a first tubular section extending from said closed one end toward said open opposite end, a second, heat conductive, tubular section extending from said open opposite end toward said closed one end, and a thermally insulating tubular means, surrounding said thermoacoustic stack, and connecting said first and second tubular sections together;

in which said means for establishing a temperature difference between said first and second ends of the stack comprises heat generating means, first heat exchange means thermally coupling said heat generating means to said first end of the stack, and second heat exchange means thermally coupling said second tubular section to said second end of the stack; and in which said second tubular section is provided with external heat exchange fins submersible in said body of water in thermal contact therewith.

7. Apparatus for projecting sound into a body of water comprising:

means providing a resonator tube, said tube being closed at one end and open at its opposite end, and having a central axis extending from the closed end toward the open end;

a thermoacoustic stack situated within said tube, said stack having first and second ends spaced from each other in the direction of the axis of the tube;

means for establishing a temperature difference between said first and second ends of the stack whereby one of said first and second ends is hotter than the other of said first and second ends; and means providing a gas for substantially filling said tube in which:

said tube-providing means, when substantially filled with said gas and submerged in a body of water with substantially the entire tube situated above the level of said open opposite end, prevents the escape of gas so that substantial entry of water into said tube is prevented by said gas;

said stack is nearer to said closed one end of the tube than to said open opposite end;

said first end of the stack is nearer than said second end to said closed one end of the tube;

said apparatus also comprises a second thermoacoustic stack situated within said tube;

said second stack has first and second ends spaced from each other in the direction of the axis of the tube;

said second stack is nearer to said open end of the tube than to said closed end;

said first end of the second stack is nearer than the second end of the stack to said open end; and said means for establishes a temperature difference also establishing a temperature difference between said first and second ends of the second stack whereby said first end of said second stack is hotter than said second end of the second stack.

8. Apparatus for projecting sound into a body of water comprising:

means providing a resonator tube, said tube being closed at one end and open at its opposite end, and having a central axis extending from the closed end toward the open end;

a thermoacoustic stack situated within said tube, said stack having first and second ends spaced from each other in the direction of the axis of the tube;

means for establishing a temperature difference between said first and second ends of the stack whereby one of said first and second ends is hotter than the other of said first and second ends; and means providing a gas for substantially filling said tube;

in which said tube-providing means, when substantially filled with said gas and submerged in a body of water with substantially the entire tube situated above the level of said open opposite end, prevents the escape of said gas so that substantial entry of water into said tube is prevented by said gas; and in which said elongated tube, said thermoacoustic stack and said means for establishing a temperature difference are all fixed together and submersible in a body of water.

9. Apparatus for projecting sound into a body of water comprising:

means providing a resonator tube, said tube being closed at one end and open at its opposite end, and having a central axis extending from the closed end toward the open end;

a thermoacoustic stack situated within said tube, said stack having first and second ends spaced from each other in the direction of the axis of the tube;

means for establishing a temperature difference between said first and second ends of the stack whereby one of said first and second ends is hotter than the other of said first and second ends; and means providing a gas for substantially filling said tube;

in which said tube-providing means, when substantially filled with said gas and submerged in a body of water with substantially the entire tube situated above the level of said open opposite end, prevents the escape of said gas so that substantial entry of water into said tube is prevented by said gas;

in which said elongated tube, said thermoacoustic stack and said means for establishing a temperature difference are all fixed together and submersible in a body of water; and in which said means providing a gas for substantially filling said tube comprises a gas source carried by said apparatus and submersible therewith, and passage means connecting said gas source to the interior of said tube.

10. Apparatus for projecting sound into a body of water comprising:

means providing a resonator tube, said tube being closed at one end and open at its opposite end, and having a central axis extending from the closed end toward the open end;

a thermoacoustic stack situated within said tube, said stack having first and second ends spaced from each other in the direction of the axis of the tube;

means for establishing a temperature difference between said first and second ends of the stack whereby one of said first and second ends is hotter than the other of said first and second ends; and means providing a gas for substantially filling said tube;

in which said tube-providing means, when substantially filled with said gas and submerged in a body of water with substantially the entire tube situated above the level of said open opposite end, prevents the escape of said gas so that substantial entry of water into said tube is prevented by said gas; and in which:

said tube comprises a first tubular section extending from said closed one end toward said open opposite end, a second tubular section extending from said open opposite end toward said closed one end, and a thermally insulating tubular means, surrounding said thermoacoustic stack, and connecting said first and second tubular sections together; and said second tubular section comprises inner and outer coaxial tubes;

the inner tube having an axial through passage providing communication between the interior of said thermally insulating tubular means and said open opposite end, and at least one transverse passage located nearer to said thermally insulating tubular means than to said open opposite end; and the outer tube having a first end on the side of said transverse passage nearer to said insulating tubular means, and a second end on the side of said transverse passage nearer to said open opposite end, said outer tube being closed at both of its ends.

* * * * *